United States Patent [19]

Shaw, Jr.

[11] Patent Number: 4,908,887

[45] Date of Patent: Mar. 20, 1990

[54] MAT ASSEMBLY

[75] Inventor: Jessie L. Shaw, Jr., 2215 Maybelle St., Tulsa, Okla. 74107

[73] Assignee: Jessie L. Shaw, Tulsa, Okla.

[21] Appl. No.: 229,307

[22] Filed: Aug. 8, 1988

[51] Int. Cl.[4] ..... A47G 9/06

[52] U.S. Cl. ..... 5/419; 5/420

[58] Field of Search ..... 5/417–420, 5/446, 447, 462

[56] References Cited

U.S. PATENT DOCUMENTS

| | | | |
|---|---|---|---|
| 1,222,513 | 4/1917 | Rosenberg | 5/419 |
| 2,853,399 | 9/1958 | Shoults | 5/417 X |
| 3,280,515 | 10/1966 | Eriksson | 5/446 |
| 3,513,491 | 5/1970 | Gordon | 5/420 |
| 3,526,911 | 9/1970 | Meyer et al. | 5/420 |
| 4,101,994 | 7/1978 | Hoyt | 5/419 |
| 4,654,907 | 4/1987 | Haugaard | 5/420 |

*Primary Examiner*—Michael F. Trettel

*Attorney, Agent, or Firm*—Walter M. Benjamin

[57] ABSTRACT

A portable, foldable liesure or utility mat comprising a plurality of elongated flexibly or hingedly connected ribs individually formed from a flat rigid core sandwiched between a lightweight insulating cushion material, said ribs of substantially equal dimensions and in parallel and foldable relationship with each other such that the mat can be rolled up and rolled out flat without curling.

12 Claims, 1 Drawing Sheet

MAT ASSEMBLY

FIELD OF THE INVENTION

This invention relates to a portable mat which can be easily rolled up for transport and storage and which can be easily rolled out without the ends of the mat curling, more particularly this mat is convenient in serving the purpose of a leisure or utility mat for insulating and cushioning a person's body from contact with the ground, floor or other contaminated or uncomfortable surface and even more particularly this mat is convenient for lying on while working under an automobile or other equipment.

BRIEF DESCRIPTION OF THE PRIOR ART

Mats of various types have been used by people for comfort for leisurely reclining at the beach, park or on the patio. They are also used for utility purposes such as for working in a reclined position under an automobile or other equipment. In these applications it is important that the mat is portable and collapsible to a small configuration for transport and storage. It is also important that the mat is a good insulating material from a hot, cold, wet or dirty surface. Further it is important that the mat has sufficient thickness so that it can be used in puddles of water or on snow. Additionally it is important that these mats provide comfort from the surface thereunder. Summarily, these mats conveniently protect a person's body from the ground or other irregular, hard or uncomfortable surface.

Mats of the prior art satisfy some but not all of these objectives. For example U.S. Pat. No. 4,450,193 to Staebler describes a mat assembly including a base portion, a face portion, a pad portion, a fastening portion and a securing portion. The pad portion of this mat is between about 4.7 and 9.5 millimeters inch thick which allows it to be rolled up and tied. The face and base are made of flexible plastic and fabric laminate material. The pad is made of flexible material such as lightweight foam and the fastening and securing portions are made of flexible materials such as strings, threads and adhesives. Hence while this mat can be used in some applications such as a person working under a car, it does not provide any rigid support for irregular surfaces nor does it provide sufficient thickness for poodles of water or snow more than about 10 millimeters deep. Further this mat does not provide a means to inhibit curling of the ends after it has been rolled up for a long period of time.

Another example is described in U.S. Pat. No. 2,551,976 to E. F. Smith. This patent describes an osteopathic bed slat comprising hingedly connected rigid slats which by folding it into a roll the slats can be made portable. These slats were particularly used by osteopaths as an unyielding surface when placed on a bed where the osteopath can treat their patients at the patients' homes. Since these slats aren't padded, they don't provide much comfort. Further in these slats it would not be anticipated that padding could be place thereon and the slats would still be easily foldable.

U.S. Pat. No. 4,662,851 to Foster describes a thick foldable swim float made of hingedly interconnected core blocks which are foldable. Since this swim float must be made of a relatively rigid bouyant material, it does not provide comfort between a person and a hard surface. Further this float cannot be rolled into a small bundle.

SUMMARY OF THE INVENTION

It is desirable to have a mat that is relatively thick and yet non curling after being folded; portable and yet of sufficient size; foldable and yet of sufficient thickness for comfort and for use in or near wet surfaces; and still have insulating properties from hot, cold or contaminating surfaces. A relatively thick cushioned, portable, foldable mat having all these characteristics has been discovered. The mat assembly of this invention is portable and foldable and comprises a plurality of elongated flexibly or hingedly connected ribs individually formed from a flat rigid core sandwiched between a light- 15 weight, insulating cushion material wherein the ribs are of substantially equal dimensions and in parallel, foldable relationship with each other. This mat satisfies all of the aforementioned desirable properties.

DESCRIPTION OF THE INVENTION

Figure 4:
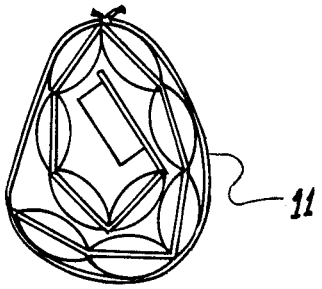
FIG. 4 is an end view of the mat in its rolled up configuration.

According to the present invention a novel mat satisfies the shortcomings of the prior art. This mat comprises a plurality of elongated ribs flexibly or hingedly connected. These ribs are of substantially the same dimensions. These connected ribs are in parallel relationship with each other wherein their integral width make up the length of the mat which is approximately 122 to 243 centimeters long. Accordingly, the ribs are approximately 3 to 16 centimeters wide and approximately 46 to 122 centimeters long. Hence by connecting these ribs in parallel side by side, their integral connected dimensions is approximately 46 to 122 centimeters wide and 122 to 243 centimeters long.

These connected ribs provide the surface for a person to lay on while leisurely reclining or comfortably working under an automobile or other equipment. In order to provide comfort from an irregular underlying surface and to facilitate the folding relationship between the ribs, the ribs are formed from a flat rigid core sandwiched between a cushion material. The cushion material can also be an insulating material. This core and cushion material have substantially the same width and length as the ribs.

The core provides reinforcement for the ribs when the mat is placed on a irregular surface. The core further and more importantly provides mass and rigidity so that the mat can be easily rolled up and stored for an extended period of time and then rolled out without the ends curling. The core is most preferably a lightweight rigid and flat wood fiberboard type material between approximately 2 millimeters and 10 millimeters thick, preferably 3 millimeters thick. While plastic sheets, sheet metal, plywood or other wood products could suffice, light weight and good insulating properties and economy are the most important factors.

This core is sandwiched between a cushioning material to form the rib. Materials such as expanded polyethylene, expanded polypropelene or expanded polyurethane are good cushioning material as well as a good insulating material. Again in choosing materials for a cushion, light weight is an important factor as well as resistance to rot and mildew. This cushion material should be approximately the same dimensions as the core and thus the same width and length as the rib. While the cushion could be between 6 and 50 millimeters thick, it is preferred that it is between 15 and 30 millimeters thick. In choosing a thickness for the cushion, the principle to consider is that the thicker the cushion, the more comfortable the mat, but on the other hand the more cumbersome the mat would be to roll up. By the same token, the thinner the padding, the less comfort and less insulating properties the mat would have.

The ribs are preferably flexibly connected by means of a flexible cover on both of its sides. This cover is sewn together between the ribs to secure the cores and cushions in place leaving approximately 6 to 25 millimeters spacing, preferably 13 millimeters, spacing between the cores. This space is dependent upon the thickness of the cushions. The thicker the cushions, greater is the amount of space needed. The covering can be cloth backed vinyl plastic or other suitable water resistant and impervous material. It is important that the flexibility of the cover is one with little memory (that is, less of a tendency to return to its original shape after bending). Its length and width will be larger than the overall size of the parallel laid ribs. Extra size of the covering will allow for the sewing of the covering between the ribs and allow approximately 13 millimeters for securing the outer boundaries of the mat. Of course other means can be used for securing the coverings together, such as adhesives including those requiring heat sealing.

While the securing of the coverings between the ribs is preferred as a means to provide the flexibility and hinge between the ribs, flexible or hinge means independent of the covering can be used such as connecting the ribs in paralled relationship together with a flexible material such as leather or rope or the like. Further, metal fasteners and the like that could act as a hinge and allow the ribs to be folded there between can also be used. Thus the mat can be easily rolled up. Further, metal fasteners and the like that will allow the ribs to fold can also be used. In the event other hinge means are used, it is still desireable to use a covering over the ribs to secure the cores and cushions in place and to protect the ribs from damage as from absorbing liquids or other contaminating materials.

After assembly of the mat, it will be readily appreciated that the rigid cores in the ribs does not allow the mat to bend except at the flexible material hinge. Thus, by bending only between the ribs, the mat can be rolled up and back out without the ends curling even though the over all thickness of the mat is between 14 and 110 millimeters thick. Preferably, the mat is between 25 and 75 millimeters thick and even more preferably, the mat is between 45 and 60 millimeters thick, wherein the overall thickness in determined by the thickness of the cushions.

This mat can be further facilitated with a head rest disposed at one end. In this embodiment of the invention, the covering should be approximately 16 centimeters longer than the overall length of the rib portion of the mat. This 16 centimeters will provide an extention of the mat for the head rest. A foam block made of the same material as the cushions approximately 25 to 50 centimeters long and 50 centimeters thick and 10 centimeters wide is covered with the same material as the ribs and secured on the 16 centimeter space. Approximately 46 to 63 centimeters space is left between the head rest and the end rib. This allows the mat to be rolled up with the head rest. Other than by sewing, brass rivits or grommets or other similar means can be disposed between the head rest and the end rib as a securing means between the upper and lower cover.

Around the periphery of the mat is a border to protect the edge of the covering material from damage and to keep out moisture from inside the mat. This border can be secured by sewing or by other similar means as described for the remainder of the mat. Preferably sewing with nylon thread is the most convenient and economical method. However, heat sealing with an adhesive would create a better barrier against moisure.

This mat can be rolled up to conserve space and conveniently stored. Ties can be attached conveniently to the mat so that when rolled up, the mat can be secured after it is rolled up. To use the mat, one simply untie the ties and hold the mat at one end and roll it out where it is to be used. This is especially convenient when one is to use it when working under an automobile because the mat can be held at one end when rolled up and unrolled beneath the automobile. This utility can be best appreciated when conditions are adverse such as in snowy conditions and under wet conditions. Similarly for leisurely relaxing, this mat can be used on the patio, in the park and on the beach to protect a person from wet grass, hot sand or a hot porch deck. After use, the mat can be washed, rolled back up and tied for transport in the trunk of a car or storage in other relatively small areas.

Figure 1:
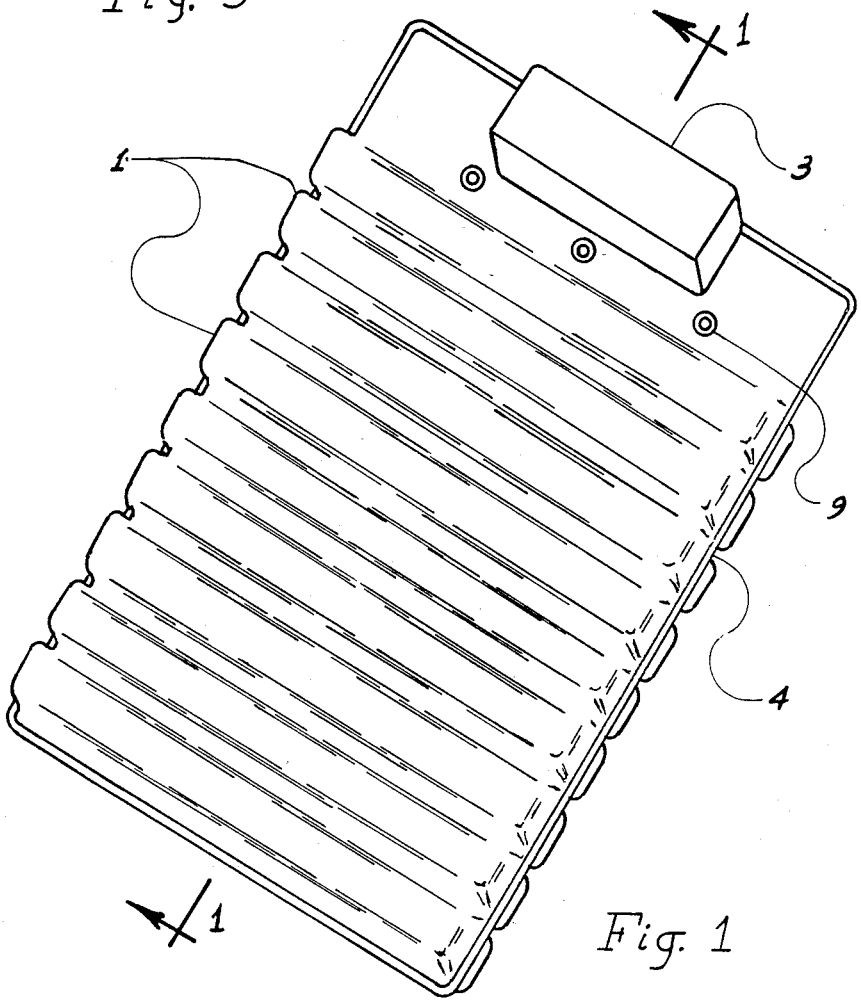
FIG. 1 is a perspective view of the mat with a headrest and edging.

Reference is now made to the drawings in which this invention is illustrated. FIG. 1 shows a perspective view of the mat. The mat is shown with eleven ribs 1. Brass grommets 9 are disposed between the end rib and head rest 3. Border 4 is disposed all around the mat.

Figure 2:
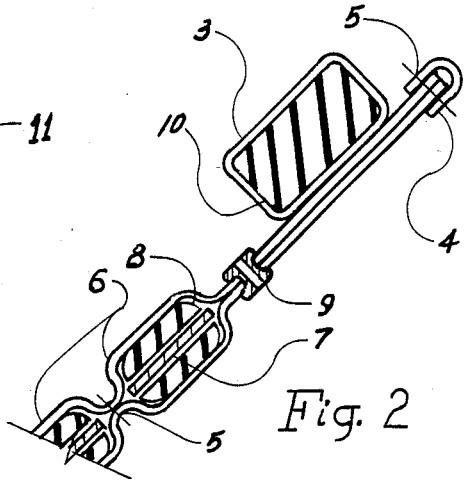
FIG. 2 is the foot end of Section 1—1 of FIG. 1.

FIG. 2 shows a section of the head end of the mat. Again the stitches 5 sewn through covering 6 secures not only the cores 7 and cushions 8, but also the cushion 10 in head rest 3 in place. (The stitching of the head rest is not shown). Also grommets 9 are disposed to hold the covering together between the rib 1 and head rest 3.

Figure 3:
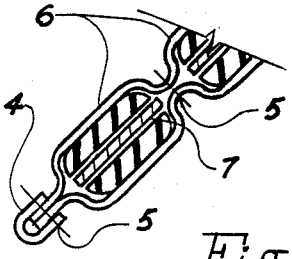
FIG. 3 is the headrest end of Section 1—1 of FIG. 1.

FIG. 3 shows a section of the foot end of the mat. Stitches 5 sewn through covering 6 at the border 4 and between ribs 1 to secure cores 7 and cushions 8 in place. It can be seen in this figure how the border protects the edge of the mat.

FIG. 4 shows the mat rolled up and tied up with ties 11. The mat can be rolled up with either the head rest 3 inside or outside. The mat should be rolled up with the head rest inside when the mat is roll out under an automobile. Thus the head rest will be under the automobile and the mat will not have to be revolved around. When it is awkward to shift the mat around, it is especially convenient to roll the mat to exactly the position desired.

This invention has been described with regard to preferred 5 embodiments. It will be apparent to those skilled in the art that variations and modifications of this detailed description and suggested use of the invention can be had without departing from the inventive concept as described in the following claims:

I claim:

1. A portable, foldable mat comprising:

A. A plurality of elongated flexibly connected adjacent ribs of substantially the same dimensions, said ribs comprising a flat rigid core and a lightweight foam cushion material, wherein said ribs are formed from the flat rigid core sandwiched between the lightweight foam cushion material;

B. a covering on both sides of the ribs; and

C. means to secure the covering together between the adjacent ribs to secure the cores and cushion material in place.

2. A portable, foldable mat comprising:

A. A plurality of elongated flexibly connected adjacent ribs of substantially the same dimensions, said ribs comprising a flat rigid core and a lightweight cushion material, wherein said ribs are formed from the flat rigid core sandwiched between the lightweight cushion material;

B. a covering on both sides of the ribs;

C. means to secure the covering together between the adjacent ribs to secure the cores and cushion material in place.

D. a head rest which is disposed on one end of the mat and wherein securing means are disposed between said head rest and an end rib of the said mat.

3. The mat of claim 2 wherein a border is secured around the periphery of the mat.

4. The mat of claim 2 wherein the core is sandwiched between a cushion material between 6 and 50 millimeters thick on each side of the core.

5. The mat of claim 2 wherein the core is sandwiched between a cushion material between 15 and 30 millimeters thick on each side of the mat.

6. The mat of claim 2 wherein the overall thickness of the mat is between 14 and 110 millimeters thick.

7. The mat of claim 2 wherein securing means are attached to said mat to secure said mat when said mat is rolled up.

8. The mat of claim 2 wherein the core is between 2 and 10 millimeters thick.

9. The mat of claim 2 wherein the covering between the ribs provides the flexibility between the ribs.

10. A portable, foldable mat comprising:

A. A plurality of elongated flexibly connected adjacent ribs of substantially the same dimensions, said ribs comprising a flat rigid core and a lightweight cushion material, wherein said ribs are formed from the flat rigid core sandwiched between the lightweight cushion material;

B. a covering on both sides of the ribs;

C. means to secure the covering together between the adjacent ribs to secure the cores and cushion material in place;

D. a headrest;

wherein said covering provides the flexible connection between the said ribs, wherein the headrest is disposed on one end of the mat and wherein the overall thickness of the mat is between 14 and 110 millimeters thick.

11. The mat of claim 10 wherein the overall thickness of the mat is from 25 to 75 millimeters thick.

12. The mat of claim 10 wherein the overall thickness of the mat is from 45 to 60 millimeters thick.

* * * * *